United States Patent [19]

Thil et al.

[11] 4,126,634

[45] Nov. 21, 1978

[54] AMINOSULFONYLCARBOXYLIC ACIDS AND THEIR SALTS

[75] Inventors: Lucien Thil; Martin Fischer, both of Ludwigshafen; Wolfgang Kindscher, Fussgoenheim, all of Fed. Rep. of Germany

[73] Assignee: BASF Aktiengesellschaft, Rheinland, Pfalz, Fed. Rep. of Germany

[21] Appl. No.: 820,722

[22] Filed: Aug. 1, 1977

[30] Foreign Application Priority Data

Aug. 28, 1976 [DE] Fed. Rep. of Germany ..... 2638860

[51] Int. Cl.[2] ..... C07C 55/02; C23F 11/10

[52] U.S. Cl. ..... 562/507; 562/556; 562/500; 562/503; 562/430; 554/383; 260/501.12; 560/150; 560/118; 560/125; 560/13; 544/85; 544/109; 544/110; 544/124; 544/128; 544/158; 252/391; 422/17

[58] Field of Search ..... 260/534 E, 501.12, 514 J, 260/518 R, 518 A, 519

[56] References Cited

U.S. PATENT DOCUMENTS 4,060,522 11/1977 Kindscher et al. ..... 260/501.12 X

*Primary Examiner*—James O. Thomas, Jr.
*Assistant Examiner*—G. T. Breitenstein
*Attorney, Agent, or Firm*—Keil, Thompson & Shurtleff

[57] ABSTRACT

Aminosulfonylcarboxylic acids and their manufacture from diamines and chlorosulfonylcarboxylic acids.

6 Claims, No Drawings

AMINOSULFONYLCARBOXYLIC ACIDS AND THEIR SALTS

The present invention relates to new aminosulfonylcarboxylic acids and their salts and to their use as corrosion inhibitors.

Wherever iron and other ferrous metals, eg. steel, are in contact with water, inorganic or organic aqueous solutions, aqueous emulsions of the oil-in-water type or aqueous dispersions of solids and similar systems having a significant proportion of water, there is the risk of corrosion occurring.

In most cases, the corrosiveness of the particular aqueous medium, in respect of its effect on machinery components, parts of apparatus, containers, pipe walls and other constructional components made of iron or iron alloys (steel), must be reduced or eliminated by corrosion-inhibiting additives. Some reduction of the tendency to corrosion is frequently achieved by merely bringing the medium to a more alkaline pH, by adding alkali metal hydroxides, alkaline salts, eg. sodium carbonate, borax, alkali metal phosphates and the like, or organic bases, eg. monoethanolamine, diethanolamine or tri-ethanolamine or other aliphatic, aromatic, cycloaliphatic or heterocyclic amines.

However, a substantial reduction in the corrosiveness of the aqueous medium is in this way only achieved at a pH above 9.5–10. The effect is in many cases in no way sufficient, especially if it is necessary to achieve long-lasting passivation of the metal surface after it is no longer in contact with the aqueous medium.

Genuine passivation is achieved in suitable cases by means of inorganic oxidizing salts, eg. sodium nitrite or sodium chromate or even nitric acid itself, but because of the toxicity of these chemicals, and because of legal regulations relating to effluents, this effect can at the present time only be utilized in rare cases and is rarely compatible with the applications mentioned at the outset. On the other hand, passivation by forming a protective layer, using suitable organic compounds which, in the neutral to alkaline pH range of interest in the present context, are mostly of anionic character, but can also be of non-ionic character or at most weakly cationic character, is of general applicability.

Amongst the compounds of the anionic type, the alkali metal salts or amine salts of straight-chain aliphatic, saturated and unsaturated carboxylic acids deserve mention; of these, the salts of oleic acid, in particular, have found acceptance. In addition, the salts of aliphatic carboxylic acids which contain carboxamide or sulfonamide groups, eg. the salts of oleoyl-sarcoside or alkanesulfonamidocarboxylic acids, have for a long time been known as being very effective in inhibiting the corrosion of iron and steel by aqueous media. More recently, as disclosed, for example, in German published application DAS No. 1,298,672, arylsulfonamidocarboxylic acids, which may or may not be substituted in the nucleus, and their salts, but also — as has generally been known for a considerable time — simple alkyl-substituted benzoic acids or alkylarylsulfonic acids, have been considered for this purpose.

However, the anionic types mentioned also suffer from substantial disadvantages. Fatty acid salts, amongst which the salts of oleic acid have been singled out particularly, are somewhat sensitive to hardness of water and this hardness greatly reduces the inhibiting action on the corrosion of iron and steel, which in any case is inadequate under severe conditions. The products containing carboxamide groups, eg. the oleoylsarcosides, are, it is true, less sensitive to water hardness but have a tendency to foam readily, which is difficult to control and restricts their usefulness.

The above arylsulfonamidocarboxylic acids, which may or may not be substituted in the nucleus, and their salts, only inhibit corrosion and at the same time foam sufficiently little if they are alkylated at the amide nitrogen, which entails additional expense. Furthermore, they must be based on aromatic sulfo compounds, in order to enable the sulfonamido groups to be formed, and these starting materials have in recent times appeared rather undesirable in respect of waste water treatment. The above alkanesulfonamidocarboxylic acids and their salts also suffer from the fact that the amide nitrogen requires additional alkylation and nevertheless the products foam excessively.

Amongst the non-ionic or weakly cationic corrosion inhibitors which have been generally known for a long time and are no longer mentioned specifically in more recent patent specifications, there are to be found, above all, the alkylolamides of aliphatic carboxylic acids and their alkylolamine esters, eg. oleic acid monoethanolamide or diethanolamide, and oleic acid monoisopropanolamide and diisopropanolamide.

Compounds of weakly cationic character include the fatty acid esters of triethanolamine or of triisopropanolamine, which have also been known for a long time in this field. However, because of their low solubility in water, these types of compounds must either be used in combination with the above anionic corrosion inhibitors or can only be employed as corrosion-inhibiting emulsifier components in the oil phase of aqueous emulsions.

It is an object of the present invention to provide water-soluble or water-dispersible anionic corrosion inhibitors which have a very broad spectrum of action and of applications and which, above all, do not suffer from the above disadvantages.

We have found that this object is achieved by providing compounds of the formula I $$A\,(SO_2{-}R^1{-}COO^{\ominus}X^{\oplus})_2 \qquad \text{I}$$

where $R^1$ is alkylene of 1 to 5 carbon atoms, A is the radical of a diamine of the formula II $$-\underset{\underset{R^3}{|}}{N}-R^2-\underset{\underset{R^4}{|}}{N}- \qquad \text{II}$$

$R^2$ is alkylene of 2 to 18 carbon atoms which may or may not be interrupted by oxygen or nitrogen or is arylene which may or may not be substituted by alkyl of 1 to 4 carbon atoms, methoxy, ethoxy, chlorine or bromine, or is arylene-alkylene of 6 to 18 carbon atoms, $R^3$ and $R^4$ are hydrogen and/or identical or different linear or branched saturated, olefinically unsaturated or acetylenically unsaturated alkyl of 1 to 18 carbon atoms (if saturated) or of 2 to 18 carbon atoms (if unsaturated), which radicals may or may not be substituted by methoxy or ethoxy, or are cycloalkyl of 5 to 12 members, phenyl which may or may not be substituted by alkyl of 1 to 3 carbon atoms, methoxy, ethoxy, chlorine or bromine, or phenylalkyl, where alkyl is of 1 to 6 carbon atoms, or together are the ethylene radical, and $X^{\oplus}$ is a proton, an alkali metal cation, half an alkaline earth metal cation or a substituted or unsubstituted ammonium cation.

The new compounds can be manufactured in a simple manner, namely by reacting diamines of the formula III $$AH_2 \qquad \text{III}$$

where A has the meaning given for formula I, with chlorosulfonylcarboxylic acid esters of the formula IV $$ClSO_2—R^1COOR^5 \qquad \text{IV}$$

where $R^1$ is defined as in formula I and $R^5$ is alkyl of 1 to 5 carbon atoms, and converting the resulting esters, by conventional methods, into the free acid or its alkali metal salts or substituted or unsubstituted ammonium salts.

The starting compounds for the manufacture of the compounds of the invention are diamines of the formula III, and are therefore, for the purposes of the invention, open-chain diamines or piperazine.

The open-chain diamines are of 2 to 18 carbon atoms.

The hydrocarbon skeleton may be of the linear or branched, saturated or unsaturated, aliphatic type; it can furthermore be interrupted by hetero-atoms, eg. oxygen or nitrogen, and by groups such as

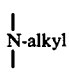

(where alkyl is of 1 to 4 carbon atoms),

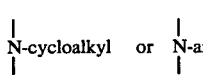

and also by cycloaliphatic radicals, eg. cyclo-hexylene, cyclopentylene, dicyclohexylene or dicyclopentylene (which latter may be interrupted by methylene or isopropylene), cycloalkylene-n-alkylene, optionally alkyl-substituted (alkyl being of 1 to 4 carbon atoms), methoxy-substituted, ethoxy-substituted, chlorine-substituted or bromine-substituted arylene or mixed alkylene-arylene, eg. benzylene, and bis-aromatic arylene which may or may not be interrupted by methylene, isopropylene or sulfone. The diamines may be primary (in which case $R^3$ and $R^4$ are hydrogen) or secondary. In the latter case, $R^3$ and $R^4$ may be identical or different and may be methyl, ethyl, n-propyl, iso-propyl, n-butyl, iso-butyl, n-hexyl, n-octyl, hexyl-isomer mixtures, 2-ethyl-n-hexyl, 2-methyl-n-butyl, methoxyethyl, cyclohexyl, n-dodecyl, stearyl, oleyl, 2-methylbutyn-3-yl, phenyl, tolyl, methoxyphenyl, ethoxyphenyl, benzyl, phenylethyl, phenyl-n-butyl or phenyl-n-hexyl.

Specific examples of particularly preferred diamines are ethylenediamine, 1,3-diaminopropane, 1,4-diaminobutane, 1,5-diaminopentane, 1,6-diaminohexane, 1,10-diaminodecane, 1,12-diaminododecane, 1,2-propylenediamine, 2,5-dimethyl-2,5-diaminohexane, 1,2-, 1,3- and 1,4-diaminocyclohexane, 1,2-, 1,3- and 1,4-phenylenediamine, 3-amino-1-methylaminopropane, 3-amino-1-cyclohexylaminopropane, 2-aminomethylcyclopentylamine, 4,4'-diaminodicyclohexylmethane, 3,3'-dimethyl-4,4'-diaminodicyclohexylmethane, 2,2-bis-(4'-aminocyclohexyl)-propane, 4,4'-diaminodiphenylmethane, 3,3'-dimethyl-4,4'-diaminodiphenylmethane, 2,2-bis-(4'-aminophenyl)-propane, 1,1-bis-(4'-aminophenyl)-cyclohexane, piperazine, N,N'-dimethyl-4,4'-diaminodiphenylmethane, 4,9-dioxadodecane-1,12-diamine, 6,6-dimethyl-4,8-dioxa-undecane-1,11-diamine, bis-(3-aminopropyl)-methylamine and 3-methyl-4-aminocyclohexyl-(3'-methyl-4'-aminophenyl)-methane.

The other starting compounds are the chlorosulfonylcarboxylic acid esters of the formula IV. Specific examples of these are methyl, ethyl and isopropyl chlorosulfonylacetate or 3-chlorosulfonylpropionate, methyl, ethyl and isopropyl 3- and 4-chlorosulfonylbutyrate and the corresponding esters of chlorosulfonyl-n-valeric acid and chlorosulfonyl-isovaleric acid.

These starting compounds may be manufactured by, for example, photosulfochlorination of the corresponding carboxylic acid esters or by adduct formation of alkali metal bisulfite, alkaline earth metal bisulfite or ammonium bisulfite with $\alpha,\beta$-unsaturated esters and the reaction of the resulting salts of the sulfonylcarboxylic acid esters with, for example, an inorganic acid chloride, eg. $SOCl_2$, $COCl_2$ or $PCl_5$.

Alkaline compounds required for the reaction of the amines with the chlorosulfonylcarboxylic acid esters or for the use of the resulting reaction products include alkaline earth metal hydroxides and alkali metal hydroxides or one of the above diamines of the formula III, which in that case must be employed in a half-molar excess over the chlorosulfonylcarboxylic acid ester. Preferably, however, inorganic bases, eg. sodium hydroxide, are used.

Any inorganic or organic bases which give water-soluble products may be used to form the salts of the aminosulfocarboxylic acids. For the purposes of the invention, water-soluble includes the colloidal, emulsoid and suspensoid state. Examples of bases used for forming the salts are alkali metal hydroxides, alkaline earth metal hydroxides or, preferably, organic bases, eg. monomethylamine, dimethylamine and trimethylamine, monoethylamine, diethylamine and triethylamine, monoisopropylamine, diisopropylamine and triisopropylamine, mono-, di- and tri-n-butylamine and -isobutylamine, 2-methoxyethylamine, 3-methoxypropylamine, 2-ethylhexylamine, monoethanolamine, diethanolamine and triethanolamine, 3-aminopropanol, cyclohexylamine, N,N-dimethylcyclohexylamine, morpholine, pyridine, quinoline, ethylenediamine, diethylenetriamine, pentaethylenehexamine and ethoxylated or propoxylated primary amines.

To form the salts, the components may be employed in the stoichiometric ratio or with either component in an excess of up to 200 mole %.

To form the sulfonamides, the molar ratio of the chlorosulfonylcarboxylic acid ester of the formula IV to the diamine of the formula III may be from 2 : 2.5 to 2 : 1, but is preferably about 2 : 1. The hydrogen chloride liberated in the reaction may, depending on the amount of the excess of basic reactant, be found either by excess amine or by adding another base, eg. a tertiary amine or an alkali metal hydroxide or alkaline earth metal hydroxide.

The reaction may be effected by simultaneously mixing all three components or by taking one or two components and then adding, respectively, the two remaining components or the third component. For example, the amine may be taken and the chlorosulfonylcarboxylic acid ester and alkaline compound run in simultaneously. In the reaction of the sulfochloride with the amine in the molar ratio of 2 : 1 the best yields are obtained, however, by taking the amine, adding a molar amount of the corresponding chlorosulfonylcarboxylic acid ester and then running in the remainder of the chlorosulfonylcarboxylic acid ester and 2 moles of, for example, an inorganic base simultaneously from two different feed vessels. A suitable reaction medium is water or an organic solvent; the reactants may be present in one homogeneous phase or in two phases, in solution, emulsion or suspension. In a preferred embodiment, a two-phase aqueous system is used. The components may be employed diluted or undiluted, but a concentration range of from 0.2 to 5.0 moles/l has proved advantageous; the best yields are obtained using concentrations of from 1.0 to 3.0 mole/l. The sulfonamide formation takes place over the entire alkaline range, but a pH of from 7 to 9 is advantageous and from 8 to 8.5 has proved the optimum. The sulfonamide formation takes place satisfactorily at temperatures from −40° to +40° C. The best yields are obtained at from −20° C to +20° C; in a preferred embodiment, the temperature is maintained at from −5° to +5° C. The reaction time for sulfonamide formation depends, especially in the case of two-phase operation, very much on the intensity of mixing of the components; the reaction times are shortest if the stirrer blade or segment is set to disturb the phase boundary of the reaction mixture.

The aminosulfonylcarboxylic acid esters may be isolated in accordance with conventional methods of working up and be converted to the amidosulfocarboxylic acid by conventional methods of hydrolysis.

However, in a preferred embodiment the amidosulfocarboxylic acid ester is not isolated but instead is hydrolyzed directly after adding further amine or alkali metal hydroxide or alkaline earth metal hydroxide; this requires temperatures of from 60° to 100° C, but the best yields are obtained at from 75° to 85° C. The hydrolysis takes place with satisfactory yields over the entire alkaline range; the reaction times are particularly short in a strongly alkaline medium. The amine, alkali metal hydroxide or alkaline earth metal hydroxide may be added in amounts of up to a molar excess, but the best yields are obtained with from 10 to 20% excess of the base.

The aminosulfonylcarboxylic acids obtained after acidifying the aminosulfonylcarboxylic acid salts with commercial inorganic acids may be isolated by the conventional methods of working up and are converted very simply, by neutralizing with the stated organic or inorganic bases, into the corrosion inhibitors of the invention.

The alkali metal salts or alkaline earth metal salts of the aminosulfonylcarboxylic acids can, as has already been explained, also form at the state of ester hydrolysis. The salts with organic amines can easily be obtained by adding to the free aminosulfonylcarboxylic acid the stoichiometric amount, or an excess, of the appropriate amine.

In most cases it is necessary to heat the mixture slightly, whilst stirring, until the salt formation reaction starts. Excessive heating due to the heat of neutralization liberated must be prevented by thorough stirring, if necessary coupled with effective cooling. Particularly high exothermicities can be dealt with by adding the amine in small portions, whilst stirring, to the aminosulfonylcarboxylic acid, which is preheated to about 50° C and is contained in the reaction vessel, and in each case waiting with the next portion of amine until the temperature begins to fall below the preferred mean temperature level of about 50° C.

The amounts in which the compounds are added as corrosion inhibitors depend on the nature of the yields with which the iron or ferrous metal comes into contact.

Examples of such applications are cooling fluids, hydraulic fluids, mineral oil-free water-soluble metalworking fluids, metalworking emulsions, cutting oils, grinding and polishing emulsions and dispersions, and metal cleaners of very diverse types, as well as corrosion-inhibiting surface-treatment agents, eg. corrosion-inhibiting emulsions and water-based passivating solutions. Process waters, which come into contact with iron and steel, from the chemical industry and other branches of industry are further examples.

Depending on the application, from 0.5 to 5.0 per cent by weight, or occasionally more, based on the liquid medium in question, of the salts of the aminosulfonylcarboxylic acids to be used according to the invention are employed.

The Examples which follow illustrate the invention.

EXAMPLE 1

Ethylene-bis-(3-aminosulfonylpropionic acid)

1. 93.25 parts of methyl 3-chlorosulfonylpropionate are added dropwise at 0° in the course of about 30 minutes, whilst stirring, to 30 parts of ethylenediamine and 200 parts of tetrahydrofuran/water mixture (30/70), and thereafter 93.25 parts of methyl 3-chlorosulfonylpropionate and 412 parts of 15% strength potassium hydroxide solution are added dropwise simultaneously from separate dropping funnels. The two-phase system is stirred for 3 hours at ≈4° C and overnight at room temperature; the organic phase is separated off, dried and concentrated. 62.9 parts (35% of theory) of ethylene-bis-(methyl 3-aminosulfonylpropionate) are obtained as white crystals.

Melting point = 115° - 116° C (after 3 recrystallizations from methanol)

IR ($CCl_4$): 3325, 1745, 1435, 1320 and 1130 $cm^{-1}$.

| Analysis : $C_{10}H_{20}N_2O_8S_2$ | C | H | N | O | S |
|---|---|---|---|---|---|
| Calculated | 33.32 | 5.60 | 7.77 | 35.51 | 17.79 |
| Found | 33.4 | 5.5 | 7.8 | 35.0 | 17.7 |

NMR* (DMSO-$d_6$) $\delta_{ppm}^{TMS}$ : 2.72 and 3.31 ($A_2B_2$-system, 4H, 4H), 3.04 (m, 4H), 3.66 (s, 6H), 7.30 (broad s, 2H).

*The following abbreviations are used in connection with the NMR spectra: s: singlet; d: doublet; t: triplet; m: multiplet;

2. 250 parts of ethylene-bis-(methyl 3-aminosulfonylpropionate), 1,000 parts of water, 61 parts of sodium hydroxide and 200 parts of ethanol are mixed and stirred for 3 hours at 80° C. After distilling off the ethanol, the alkaline solution is extracted with ether; the aqueous phase is acidified (pH = 1) and concentrated to ≈1,000 parts. 134 parts (58% of theory) of ethylene-bis-(3-aminosulfonylpropionic acid) precipitate.

Melting point = 161° - 167° C (from water)

IR (Nujol): 3280, 1685, 1310, 1130 $cm^{-1}$

| Analysis : $C_8H_{16}N_2O_8S_2$ | C | H | N | O | S |
|---|---|---|---|---|---|
| Calculated | 28.91 | 4.86 | 8.43 | 38.51 | 19.29 |

-continued

| Analysis : $C_8H_{16}N_2O_8S_2$ | C | H | N | O | S |
|---|---|---|---|---|---|
| Found | 28.5 | 4.8 | 8.1 | 38.0 | 18.7 |

NMR (DMSO-$d_6$) $\delta_{ppm}^{TMS}$: 2.63 and 3.27 ($A_2B_2$-system, 4H, 4H), 3.05 (m, 4H), 7.28 (broad s, 2H).

EXAMPLE 2

2,5-Dimethylhexa-2,5-bis-(3'-aminosulfonylpropionic acid)

1. 373 parts of methyl 3-chlorosulfonylpropionate are added dropwise at 0° C, whilst stirring, to 288 parts of 2,5-dimethylhexa-2,5-diamine and 1,000 parts of water, and thereafter 373 parts of methyl 3-chlorosulfonylpropionate and 1,067 parts of 15% strength sodium hydroxide solution are added dropwise simultaneously from separate dropping funnels. The mixture is stirred for 1 hour at 0° C and 3 hours at room temperature.

After extracting the reaction mixture with $CH_2Cl_2$, the organic phase is washed with water, 1-normal HCl and then neutral with water, dried and concentrated (45°/20 mm Hg).

117 parts (13% of theory) of 2,5-dimethylhexa-2,5-bis-(methyl 3'-aminosulfonylpropionate) are obtained as light brown crystals.

Melting point = 133° - 134° C (from methanol)

IR ($CCl_4$): 3275, 1730, 1415, 1315, 1130 $cm^{-1}$

NMR ($CDCl_3$) $\delta_{ppm}^{TMS}$: 1.39 (s, 12H), 1.71 (s, 4H), 2.85 and 3.41 ($A_2B_2$-System, 4H, 4H), 3.78 (s, 6H), 4.67 (s, 2H).

2. Hydrolysis under the conditions of Example 1 gives 2,5-dimethylhexa-2,5-bis-(3'-aminosulfonylpropionic acid).

IR (Film): 3290, 1690, 1310, 1130 $cm^{-1}$

AN* Calculated: 270. Found: 276.

*Acid number

EXAMPLE 3

Hexamethylene-bis-(3-aminosulfonylpropionic acid)

1. 37.3 parts of methyl 3-chlorosulfonylpropionate are added dropwise to 23.2 parts of hexamethylenediamine and 100 parts of water at 0° C, whilst stirring, and thereafter 37.3 parts of methyl 3-chlorosulfonylpropionate and 106.7 parts of 15% strength sodium hydroxide solution are added dropwise simultaneously from separate dropping funnels. The mixture is stirred for 1 hour at 0° C and 3 hours at room temperature.

The resulting precipitate of hexamethylene-bis-(methyl 3-amidosulfopropionate) is filtered off and washed with water.

Melting point (from $H_2O$—$CH_3OH$, 1:1): 120° - 121° C

IR (Film): 3260, 1725, 1445, 1310, 1135 $cm^{-1}$

NMR ($CDCl_3$ + DMSO-$D_6$) $\delta_{ppm}^{TMS}$: 1.43 (broad s, 8H), 2.80 and 3.26 ($A_2B_2$-system, 4H, 4H), 2.9 (m, 4H), 3.70 (s, 6H), 6.5 (m, 2H).

2. The hexamethylene-bis-(methyl 3-aminosulfonylpropionate) obtained above, 300 parts of water and 12 parts of sodium hydroxide are mixed and stirred for 5 hours at 80° C. After stripping off the methanol, the alkaline solution is extracted with ether; the aqueous phase is acidified with 1-normal HCl (pH 1) and the precipitate formed is filtered off, washed with water and dried at 50° C in a vacuum drying oven (25 mm Hg).

18.85 parts (24.3% of theory, based on amine employed) of hexamethylene-bis-(3-aminosulfonylpropionic acid) are obtained as white crystals.

Melting point: 173° -175° C.

IR (Film): 3285, 1690, 1305, 1135 $cm^{-1}$

NMR (DMSO-$d_6$) $\delta_{ppm}^{TMS}$: 1.36 (broad s, 8H), 2.65 and 32.5 ($A_2B_2$-system, 4H, 4H), 2.95 (m, 4H), 5.65 (broad s, 2H), 7.11 (t, 2H).

EXAMPLE 4

3',3''-Dimethyl-4,4'-diaminodicyclohexylmethane-4',4''-bis-(3-aminosulfonylpropionic acid)

1. 37.3 parts of methyl 3-chlorosulfonylpropionate are added dropwise to 47.6 parts of 3,3'-dimethyl-4,4'-diaminodiphenylmethane and 100 parts of water at 0° C, whilst stirring, and thereafter 37.3 parts of methyl 3-chlorosulfonylpropionate and 106.7 parts of 15% strength sodium hydroxide solution are added dropwise simultaneously from separate dropping funnels. The mixture is stirred for 1 hour at 0° C and 3 hours at room temperature.

After extracting the reaction mixture with $CH_2Cl_2$, the organic phase is washed with water, 1-normal HCl and again with water, dried and concentrated (45° C/20 mm Hg).

51.5 parts (48% of theory) of 3',3''-dimethyldicyclohexylmethane-4',4''-bis-(methyl 3-aminosulfonylpropionate) are obtained as a yellowish, viscous mass.

IR (Film): 3300, 1735, 1445, 1325, 1150 $cm^{-1}$

NMR ($CDCl_3$) $\delta_{ppm}^{TMS}$1.04 (m, 6H), 2.83 and 3.37 (4H, 4H), 3.77 (s, 6H, 5.0 (t, 2H), 8.06 (broad s, 2H).

2. 49.7 parts of 3',3''-dimethyldicyclohexylmethane-4',4''-bis-(methyl 3-aminosulfonylpropionate), 150 parts of water, 8.1 parts of sodium hydroxide and 50 parts of ethanol are mixed and stirred for 4 hours at 80° C. After stripping off the ethanol, the alkaline solution is extracted with ether; the aqueous phase is acidified with 1N HCl (pH 1) and the oil which has separated out is removed; after drying under reduced pressure (60° C, 2 mm Hg) the oil (31.6 parts, 68% of theory) becomes crystalline.

Melting point: 109° - 114° C

IR (Nujol): 3200 - 2200 (broad absorption), 1710, 1445, 1315, 1130 $cm^{-1}$.

NMR (DMSO-$d_6$) $\delta_{ppm}^{TMS}$: 0.96 (m, 6H), 2.62 and 3.21 (4H, 4H), 7.05 (m, 2H).

EXAMPLE 5

Diphenylmethane-4',4''-bis-(3-aminosulfonylpropionic acid)

1. 37.3 parts of methyl 3-chlorosulfonylpropionate are added dropwise to 42 parts of 4,4'-diaminodiphenylmethane and 100 parts of water at 0° C, whilst stirring, and 37.3 parts of methyl 3-chlorosulfonylpropionate and 106.7 parts of 15% strength sodium hydroxide solution are then added dropwise simultaneously from separate dropping funnels. The mixture is stirred for 1 hour at 0° C and 3 hours at room temperature.

After extracting the reaction mixture with $CH_2Cl_2$, the organic phase is washed with water, 1N HCl and again with water, dried and concentrated (45°/25 mm Hg).

59.9 parts of diphenylmethane-4',4''-bis-(methyl 3-aminosulfonylpropionate) are obtained as pale yellow crystals.

IR (Film): 3215, 1740, 1445, 1340, 1160 $cm^{-1}$

NMR ($CDCl_3$) $\delta_{ppm}^{TMS}$: 2.82 and 3.44 (4H, 4H), 3.67 (s, 6H), 3.91 (s, 2H), 7.22 (s, 8H), 7.45 (s, 2H).

2. 59.2 parts of diphenylmethane-4',4''-bis-(methyl 3-aminosulfonylpropionate), 150 parts of water, 10.2 parts of sodium hydroxide and 50 parts of ethanol are mixed and stirred for 4 hours at 80° C. After stripping off the ethanol, the alkaline solution is extracted with ether; the aqueous phase is acidified with 1N HCl and the diacid which precipitates is filtered off, washed with $H_2O$ and $CH_2Cl_2$ and dried (40° C/25 mm Hg). 35.6 parts (64% of theory) of diphenylmethane-4',4''-bis-(3-aminosulfonylpropionic acid) are obtained.

Melting point: 154° - 155° C (from $CH_3OH/H_2O$, 1:1)

IR (Nujol): 3200 - 2200 (broad absorption), 1690, 1600, 1500, 1460, 1330, 1130 $cm^{-1}$

| Analysis : $C_{19}H_{22}N_2O_8S_2$ | C | H | N | 0 | S |
|---|---|---|---|---|---|
| Calculated | 48.49 | 4.72 | 5.95 | 27.20 | 13.63 |
| Found | 48.4 | 4.4 | 6.1 | 27.1 | 13.5 |

NMR (DMSO-$d_6$) $\delta_{ppm}^{TMS}$: 2.63 and 3.28 (4H, 4H), 3.86 (s, 2H), 7.20 (s, 8H), 9.78 (s, 2H).

EXAMPLE 6

4,9-Dioxadodeca-1,12-bis-(3'-aminosulfonylpropionic acid)

1. 37.3 parts of methyl 3-chlorosulfonylpropionate are added dropwise to 40.8 parts of 4,9-dioxadodeca-1,12-diamine and 100 parts of water at 0° C, whilst stirring, and 37.3 parts of methyl 3-chlorosulfonylpropionate and 106.7 parts of 15% strength sodium hydroxide solution are then added dropwise simultaneously from separate dropping funnels. The mixture is stirred for 1 hour at 0° C and 3 hours at room temperature.

The resulting precipitate of 4,9-dioxadodeca-1,12-bis-(methyl 3'-aminosulfonylpropionate) is filtered off, washed with water and dried.

Melting point: 100° - 101° C (from $CH_3OH$)

IR: 3270, 1720, 1430, 1310, 1145, 1130 $cm^{-1}$

NMR ($CDCl_3$) $\delta_{ppm}^{TMS}$: 1.66 and 1.88 (m, 8H), 2.88 (m, 4H), 3.4 (m, 16H), 3.72 (s, 6H), 5.20 (t, 2H).

| Analysis : $C_{18}H_{36}N_2O_{10}S_2$ | C | H | N | 0 | S |
|---|---|---|---|---|---|
| Calculated | 42.84 | 7.20 | 5.55 | 31.70 | 12.71 |
| Found | 43.4 | 7.0 | 5.4 | 31.4 | 12.4 |

2. The 4,9-dioxadodeca-1,2-bis-(methyl 3'-aminosulfonylpropionate) obtained above, 300 parts of water and 12 parts of sodium hydroxide are mixed and stirred for 5 hours at 80° C. After stripping off the methanol, the alkaline solution is extracted with ether and acidified with 1N HCl (pH 1) and the precipitate which hereupon forms is filtered off, washed with water and dried at 80° C under reduced pressure; after one recrystallization from methanol, 16.7 parts of 4,9-dioxadodeca-1,12-bis-(3'-aminosulfonylpropionic acid) are obtained.

Melting point: 138° - 143° C

IR: (Nujol): 3400 - 2200 (broad absorption)m 3270, 1685, 1310, 1130 $cm^{-1}$

NMR (DMSO-$D_6$) $\delta_{ppm}^{TMS}$1.53 (m, 4H), 1.68 (m, 4H), 2.53 and 3.23 (4H, 4H), 3.0 (m, 4H), 3.40 (m, 8H), 7.12 (broad s, 2H).

| Analysis : $C_{16}H_{32}N_2O_{10}S_2$ | C | H | N | 0 | S |
|---|---|---|---|---|---|
| Calculated | 40.32 | 6.78 | 5.88 | 33.57 | 13.54 |
| Found | 40.00 | 6.50 | 5.90 | 33.02 | 13.00 |

EXAMPLE 7

N-Cyclohexyl-trimethylene-bis-(3-aminosulfonylpropionic acid)

1. 37.3 parts of methyl 3-chlorosulfonylpropionate are added dropwise to 31.2 parts of 3-amino-1-cyclohexylaminopropane and 100 parts of water at 0° C, whilst stirring, and 37.3 parts of methyl 3-chlorosulfonylpropionate and 106.7 parts of 15% strength sodium hydroxide solution and then added dropwise simultaneously from separate dropping funnels. The mixture is stirred for 1 hour at 0° C and 3 hours at room temperature. After extracting the reaction mixture with $CH_2Cl_2$, the organic phase is washed with water, 1N HCl and neutral with water, and is dried and concentrated (45°/25 mm Hg).

6.9 parts of N-cyclohexyl-trimethylene-bis-(methyl 3-aminosulfonylpropionate) are obtained as a yellowish oil.

IR (Film): 3260, 1735, 1445, 1325, 1140 $cm^{-1}$

NMR ($CDCl_3$) $\delta_{ppm}^{TMS}$: — 1.8 ppm (broad peak, 12H), 3.72 (s, 6H), 5.3 (broad s, 1H).

2. Hydrolysis under the conditions of Example 6 gives N-cyclohexyl-trimethylene-bis-(3-aminosulfonylpropionic acid).

IR (Film): 3450 - 2200 (broad absorption), 1690, 1320, 1120 $cm^{-1}$

AN calculated: 262. Found: 271.

EXAMPLE 8

Diphenylmethane-4',4''-bis-(3-methylaminosulfonylpropionic acid)

1. 46.6 parts of methyl 3-chlorosulfonylpropionate are added dropwise to 56.5 parts of N,N'-dimethyl-4,4'-diaminodiphenylmethane and 100 parts of water at 0° C, whilst stirring, and 46.6 parts of methyl 3-chlorosulfonylpropionate and 113.3 parts of 15% strength sodium hydroxide solution are then added dropwise simultaneously from separate dropping funnels. The mixture is stirred for 1 hour at 0° C and 3 hours at room temperature. After extracting the reaction mixture with $CH_2Cl_2$, the organic phase is washed with water, 1N HCl and neutral with water, and is dried and concentrated.

109.2 parts of diphenylmethane-4',4''-bis-(methyl 3-aminosulfonylpropionate) (83% of theory) are obtained.

IR (Film): 3030, 1740, 1510, 1440, 1345, 1260, 1140 $cm^{-1}$

NMR ($CDCl_3$) $\delta_{ppm}^{TMS}$: 2.80 and 3.37 ($A_2B_2$-system, 4H, 4H), 3.33 (s, 6H), 3.73 (s, 6H), 4.00 (s, 2H), 7.34 (AB-system, 4H, 4H).

| Analysis : $C_{23}H_{30}N_2O_8S_2$ | C | H | N | 0 | S |
|---|---|---|---|---|---|
| Calculated | 52.45 | 5.75 | 5.32 | 24.30 | 12.17 |
| Found | 52.0 | 5.6 | 5.4 | 22.0 | 11.1 |

2. Hydrolysis under the conditions of Example 6 gives diphenylmethane-4',4''-bis-(3-methylaminosulfonylpropionic acid).

IR (Film): 3300 – 2200 (broad absorption), 1690, 1595, 1500, 1320, 1130 $cm^{-1}$ AN calculated: 219. Found: 225.

Tests on the products of the Invention (a) Herbert corrosion test

The corrosion-inhibiting action is illustrated by using a 1% strength aqueous solution of the active ingredient in water of 10° German hardness, by means of the Herbert test system extensively used in the metalworking sector. This employs a standardized grey cast iron plate and standardized steel chips of 5 mm length, supplied by Alfred Herbert, Coventry, England. Before carrying out the test, the square plate, of size 100 × 100 × 5 mm, is carefully ground by means of a belt grinder using grade 120 emery cloth, and is washed with white spirit and ethanol and dried with a clean cloth. The steel chips supplied with the test system, which are produced under standardized conditions from 0.40% carbon steel are then placed, by means of a suitable metal or plastic spoon having the capacity of a normal teaspoon, in 4 piles on the prepared grey cast iron plate so as to be equidistant from one another and from the edges of the plate. The chips should be in the form of a very closely packed single layer.

The solutions or emulsions to be tested for their corrosion characteristics are placed on the piles of chips, by means of a measuring pipette, in such amount that the liquid which reaches the cast steel plate is only just held together by the chips. After standing for 24 hours in an atmosphere of 70% relative humidity, the chips are shaken off the plate by tipping the latter. The clearly visible outline of the dried-on aqueous medium remains. At the points of contact of the chips with the plate, rust marks of greater or lesser extent, depending on the corrosiveness of the liquid, have formed; these marks may even have merged into a continuous layer of rust. The results can be assessed by visually estimating the proportion of rust as a percentage of the area.

(b) Grey cast iron filter test

This is a further corrosion test. A Petri dish of about 10 cm internal diameter, with a suitable covering dish is used. A circular paper filter is placed in the Petri dish. Using a suitable spoon, from 5 to 10 g of coarse grey cast iron GG 20 chips are spread over the filter so as to produce a uniform pile in the middle, which is about 1.5 cm clear of the edge all the way round. The chips have a length of from 5 to 8 mm and must be produced from clean grey cast iron GG 20 material without using cutting oil or any other coolant/lubricant. All fines must be sieved out.

5 ml portions of the solution or emulsion to be tested for corrosiveness are placed uniformly on the chips by means of a measuring pipette. The pH of the test liquid is recorded since it is of essential importance in making the assessment. It can be brought to a particular standard, eg. 8.5. After the chips have been moistened, the covering dish is placed on top and the sample is left to stand for 2 hours under normal laboratory conditions at from 23° to 25° C and at about 70% relative atmospheric humidity. The lid is then removed and the filter is freed from the chips by briefly floating it, inverted, on a dish of tap water. Immediately thereafter, the filter is sprayed, and impregnated, with an indicator solution composed of 1 g of potassium ferricyanide, 30 g of sodium chloride and 1 l of water. The indicator is then allowed to act for 17 seconds in air. Finally, the filter is carefully rinsed under running tapwater and is dried in air, in a moderately warm place. After this procedure, brownish yellow, yellow and/or bluish green patches of various intensities are found on the filter paper, depending on the corrosiveness of the medium, the brownish yellow or yellow color being regarded as more disadvantageous. Satisfactory behavior is shown by the absence of any brown or yellow coloration with the presence of, at most, traces of bluish green, pale patches. The color of the filters is completely stable and the filters can therefore be used for documentation purposes.

A scale of merit is:

very poor: intense, large, predominantly yellowish brown patches.

poor: intense, large patches with about equal proportions of yellowish brown and bluish green.

moderate: faded, medium-size patches with about equal proportions of yellow and bluish green.

good: very faded, small (pinhead-size) patches with bluish green predominating.

very good: no patches or at most a very small number of very small pale bluish green patches.

(c) Foaming characteristics

DIN 53,902 "Bestimmung des Schaumvermögens und der Schaumbeständigkeit" ("Determination of the foaming power and of the foam stability") can be employed for testing the foaming characteristics. It suffices to use the simplified test procedure, in which the ram carrying the perforated plate is moved uniformly up and down manually 30 times in 30 seconds and is then carefully withdrawn (IG whipping method). The foam volume is read off, in ml, on the graduated foam cylinder after 1, 5 and 10 minutes. In addition, the temperature, concentration and water hardness data are of importance.

The following products were compared with one another by the test procedures (a) to (c), described above, in order to illustrate the differences in action:

Triethanolamine salts of:

1. 3′,3″-Dimethyldicyclohexylmethane-4′,4″-bis-(3-aminosulfonylpropionic acid).
2. Diphenylmethane-4′,4″-bis-(3-aminosulfonylpropionic acid).
3. Sodium oleate.
4. Oleoylsarcoside.
5. Sodium salt of an alkylsulfamidoacetic acid, where alkyl is of 13 to 15 carbon atoms.
6. Phenylsulfonylamidocaproic acid.
7. N-(2′-Ethyl-n-hexyl)-3-aminosulfonylpropionic acid.

The test results are recorded in the accompanying Table. Water of 10° German hardness was used. The pH was adjusted to 8.5 by means of triethanolamine in the case of the triethanolamine salts and by means of sodium hydroxide solution in the case of the sodium salt (5). It is to be noted that the grey cast iron filter test in general gives somewhat more sensitive results and that the results of the two tests do not always go hand in hand. However, good to very good performance shown in parallel in both tests in most cases also indicates good performance in practical use.

The inhibitors of the invention (1 and 2) show excellent low-foam characteristics and in addition good to very good corrosion inhibition. They are, in respect of this combination of properties, superior to materials 3 to 6 of the prior art, on which comparative measurements were carried out, and are therefore very suitable for forming the anti-corrosion adsorption layer on the metal surface.

TABLE

| Product No. | Corrosion characteristics (25° C, 10° German hardness) pH | concentration (g/l) | a) Herbert test (rust as % of surface area) | b) Grey cast iron test | c) Foaming characteristics (25° C,2g/l,10° German hardness) (ml of foam) 1 minute | 5 minutes | 10 minutes |
|---|---|---|---|---|---|---|---|
| 1 | 8.5 | 10 | 10 | medium to good | 10 | 0 | 0 |
| | | 30 | 0 | very good | | | |
| 2 | 8.5 | 10 | 0 | very good | 5 | 0 | 0 |
| | | 30 | 0 | very good | | | |
| 3 | 8.5 | 10 | 10 | medium to good | 130 | 80 | 70 |
| | | 30 | 0 | almost very good | | | |
| 4 | 8.5 | 10 | 0 | very good | 45 | 25 | 15 |
| | | 30 | 0 | very good | | | |
| 5 | 8.5 | 10 | 0 | medium to good | 25 | 15 | 10 |
| | | 30 | 0 | good to very good | | | |
| 6 | 8.5 | 10 | 0 | medium to good | 25 | 15 | 5 |
| | | 30 | 0 | very good | | | |
| 7 | 8.5 | 10 | 0 | very good | 0 | 0 | 0 |
| | | 30 | 0 | very good | | | |

We claim:

1. A compound of the formula I $$A-(SO_2-R^1-COO^{\ominus}X^{\oplus})_2 \qquad \text{I}$$

where $R^1$ is alkylene of 1 to 5 carbon atoms, A is the radical of a diamine of the formula II $$-\underset{\underset{R^3}{|}}{N}-R^2-\underset{\underset{R^4}{|}}{N}- \qquad \text{II}$$

$R^2$ is alkylene of 2 to 18 carbon atoms, alkylene of 2 to 18 carbon atoms interrupted by oxygen or nitrogen, arylene, arylene substituted by alkyl of 1 to 4 carbon atoms, methoxy, ethoxy or halogen, or arylene-alkylene of 6 to 18 carbon atoms, $R^3$ and $R^4$ are identical or different radicals chosen from hydrogen, linear and branched saturated, olefinically unsaturated or acetylenically unsaturated alkyl of 1 to 8 carbon atoms, if saturated, or of 2 to 18 carbon atoms, if unsaturated, alkyl of the above type substituted by methoxy or ethoxy, cycloalkyl of 5 to 12 members, phenyl, phenyl substituted by alkyl of 1 to 3 carbon atoms, methoxy, ethoxy, chlorine or bromine, or phenylalkyl, where alkyl is of 1 to 6 carbon atoms and $X^{\oplus}$ is a proton, an alkali metal cation or alkaline earth metal cation or an ammonium cation.

2. A compound of the formula I as claimed in claim 1, wherein the radical A is derived from a diamine selected from the group comprising ethylenediamine, 1,3-diaminopropane, 1,4-diaminobutane, 1,5-diaminopentane, 1,6-diaminohexane, 1,10-diaminodecane, 1,12-diaminododecane, 1,2-propylenediamine, 2,5-dimethyl-2,5-diaminohexane, 1,2-, 1,3- or 1,4-diaminocyclohexane, 1,2-, 1,3- or 1,4-phenylenediamine, 3-amino-1-methylaminopropane, 3-amino-1-cyclohexylaminopropane, 2-aminomethylcyclopentylamine, 4,4'-diaminodicyclohexylmethane, 3,3'-dimethyl-4,4'-diaminodicyclohexylmethane, 2,2-bis-(4'-aminocyclohexyl)-propane, 4,4'-diaminodiphenylmethane, 3,3'-dimethyl-4,4'-diaminodiphenylmethane, 2,2-bis-(4'-aminophenyl)-propane, 1,1-bis-(4'-aminophenyl)-cyclohexane, N,N'-dimethyl-4,4'-diaminodiphenylmethane, 4,9-dioxadodecane-1,12-diamine, 6,6-dimethyl-4,8-dioxa-undecane-1,11-diamine, bis-(3-aminopropyl)-methylamine and 3-methyl-4-aminocyclohexyl-(3-methyl-4'-aminophenyl)-methane.

3. A compound as set forth in claim 1, which is ethylene-bis-(3-aminosulfonylpropionic acid).

4. A compound as set forth in claim 1, which is 2,5-dimethylhexa-2,5-bis-(3'-aminosulfonylpropionic acid).

5. A compound as set forth in claim 1, which is hexamethylene-bis-(3-aminosulfonylpropionic acid).

6. A compound as set forth in claim 1, which is N-cyclohexyl-trimethylene-bis-(3-aminosulfonylpropionic acid).

* * * * *